US010751851B2

(12) United States Patent
Seger

(10) Patent No.: US 10,751,851 B2
(45) Date of Patent: Aug. 25, 2020

(54) FINISHING APPARATUS

(71) Applicant: Supfina Grieshaber GmbH & Co. KG, Wolfach (DE)

(72) Inventor: Martin Seger, Wolfach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 377 days.

(21) Appl. No.: 15/438,784

(22) Filed: Feb. 22, 2017

(65) Prior Publication Data

US 2017/0239782 A1 Aug. 24, 2017

(30) Foreign Application Priority Data

Feb. 23, 2016 (DE) ..... 10 2016 103 105

(51) Int. Cl.

| | |
|---|---|
| ***B24B 41/06*** | (2012.01) |
| ***B24B 47/02*** | (2006.01) |
| ***B24B 19/12*** | (2006.01) |
| ***B24B 5/42*** | (2006.01) |
| ***B24B 35/00*** | (2006.01) |
| ***B24B 41/00*** | (2006.01) |

(52) U.S. Cl.

CPC ..... *B24B 41/06* (2013.01); *B24B 5/42* (2013.01); *B24B 19/12* (2013.01); *B24B 35/00* (2013.01); *B24B 41/005* (2013.01); *B24B 47/02* (2013.01)

(58) Field of Classification Search

CPC ..... B24B 19/12; B24B 27/0061; B24B 35/00; B24B 41/005; B24B 41/06; B24B 41/02; B24B 5/42

USPC ..... 451/227, 392, 393, 396, 49; 269/57; 414/729

See application file for complete search history.

(56) References Cited

U.S. PATENT DOCUMENTS 2,771,716 A * 11/1956 Joyce ..... B24B 27/0023 451/246
4,637,144 A * 1/1987 Schemel ..... B23Q 17/20 33/501.03

(Continued)

FOREIGN PATENT DOCUMENTS

CN 102069441 A 5/2011
CN 105171427 A 12/2015

(Continued)

*Primary Examiner* — Joseph J Hail
*Assistant Examiner* — Arman Milanian
(74) *Attorney, Agent, or Firm* — Leydig, Voit & Mayer, Ltd.

(57) ABSTRACT

A finishing apparatus includes a workpiece-receiving device, a rotary drive configured to drive a workpiece in rotation about a workpiece axis and an oscillatory drive configured to produce a relative movement between the workpiece and a finishing tool in a direction that is parallel to the workpiece axis. A workpiece-conveying device has a workpiece holder that is moveable by a drive device between a working position in which the workpiece is in position to be machined and a loading/unloading position in which the workpiece is loadable/unloadable. The workpiece holder has a support device configured to support the workpiece. The drive device is formed as a swivel drive such that the workpiece holder is swivelable between the working position and the loading/unloading position along an arcuate swivel path.

8 Claims, 5 Drawing Sheets

(56) References Cited

U.S. PATENT DOCUMENTS

| | | | | |
|---|---|---|---|---|
| 5,027,563 | A * | 7/1991 | Naito | B23Q 7/04 451/331 |
| 6,645,047 | B1 * | 11/2003 | Liskow | B24B 5/42 451/11 |
| 6,729,936 | B1 * | 5/2004 | Hori | B24B 5/42 451/49 |
| 8,408,967 | B2 * | 4/2013 | Ido | B23Q 1/76 451/11 |
| 2004/0055172 | A1 * | 3/2004 | Danielli | G01B 5/08 33/555.1 |
| 2009/0318066 | A1 * | 12/2009 | Clay | B24B 3/36 451/369 |
| 2011/0237159 | A1 * | 9/2011 | Araki | B23Q 17/20 451/5 |
| 2011/0306281 | A1 | 12/2011 | Grabsch et al. | |
| 2014/0004774 | A1 * | 1/2014 | Falkner | B23Q 17/20 451/49 |
| 2017/0014971 | A1 | 1/2017 | Junker | |

FOREIGN PATENT DOCUMENTS

| | | | | |
|---|---|---|---|---|
| DE | 10016897 | A1 | 10/2001 | |
| DE | 102009059897 | A1 | 6/2011 | |
| DE | 102011081918 | A1 | 2/2013 | |
| DE | 102014204807 | A1 | 9/2015 | |
| EP | 2682229 | A2 * | 1/2014 | B24B 41/005 |
| JP | H 11138311 | A | 5/1999 | |

* cited by examiner

FINISHING APPARATUS

CROSS-REFERENCE TO PRIOR APPLICATION

Priority is claimed to German Patent Application No. DE 10 2016 103 105.4, filed on Feb. 23, 2016, the entire disclosure of which is hereby incorporated by reference herein.

FIELD

The invention relates to a finishing apparatus, comprising a workpiece-receiving device, a rotary drive for driving a workpiece in rotation about a workpiece axis, an oscillatory drive for producing a relative movement between the workpiece and a finishing tool in a direction that is parallel to the workpiece axis, comprising a workpiece-conveying device, which has a workpiece holder that can be moved by means of a drive device between a working position for machining a workpiece and a loading/unloading position for providing a workpiece to be machined and for removing a machined workpiece, the workpiece holder comprising a support device for supporting a workpiece.

BACKGROUND

Finishing apparatuses are used for finishing workpieces, for example crankshafts or camshafts. Bearing surfaces of said workpieces that are rotationally symmetrical in the circumferential direction are finished by the workpiece being driven in rotation about an axis of rotation. At the same time, an oscillatory movement in the direction parallel to the axis of rotation takes place between the finishing tool (for example a finishing stone or a finishing belt) and the workpiece to be finished. A cross-grinding structure that is characteristic of the finishing process is produced by finishing a workpiece.

When being machined, a workpiece is arranged in a machining position. In this machining position, the workpiece is clamped in a workpiece-receiving device. Said device usually comprises clamping elements which, when viewed along the workpiece axis, are arranged on opposite sides. For example, conical tips can engage in corresponding recesses which are provided in the end faces of the workpiece.

In order to convey the workpiece between a working position and a loading/unloading position, a workpiece-conveying device is provided. Workpieces to be finished are provided in the loading/unloading position, and are then moved into the working position by means of the workpiece-conveying device. The workpiece is transferred from the working position into the machining position by means of the above-described workpiece-receiving device, where it is finished. The workpiece is then moved back into the working position by releasing the workpiece-receiving device and from there it is moved back into the loading/unloading position by means of the workpiece-conveying device.

The change in position of the workpiece when changing between the working position and the machining position is relatively small and corresponds to an offset of a few millimeters or centimeters between the workpiece axis of the workpiece supported on the support device and a clamping axis of the workpiece-receiving device.

Finishing apparatuses comprising workpiece-conveying devices, which comprise a workpiece holder having a support device for supporting a workpiece, are known from prior uses of the applicant. In the known workpiece-conveying devices, the workpiece holder is moved between the loading/unloading position and the working position along a multi-step conveying path. For example, a workpiece to be finished is moved from the loading/unloading position into the working position by the support device of the workpiece holder first being moved along a first conveying path until the support device, together with the workpiece, is positioned below the working position. From this position, the support device is moved upwards together with the workpiece to be finished until the workpiece holder has reached the working position. From said working position, the workpiece is clamped by the workpiece-receiving device. The workpiece holder is then removed from the clamped workpiece by the workpiece holder first being lowered along the above-mentioned second conveying path and from there being moved back into the loading/unloading position along the first conveying path.

The above-described, multi-step conveying path is also required to convey the workpiece from the working position into the unloading position.

SUMMARY

In an embodiment, the present invention provides a finishing apparatus including a workpiece-receiving device, a rotary drive configured to drive a workpiece in rotation about a workpiece axis and an oscillatory drive configured to produce a relative movement between the workpiece and a finishing tool in a direction that is parallel to the workpiece axis. A workpiece-conveying device has a workpiece holder that is moveable by a drive device between a working position in which the workpiece is in position to be machined and a loading/unloading position in which the workpiece is loadable/unloadable. The workpiece holder has a support device configured to support the workpiece. The drive device is formed as a swivel drive such that the workpiece holder is swivelable between the working position and the loading/unloading position along an arcuate swivel path.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
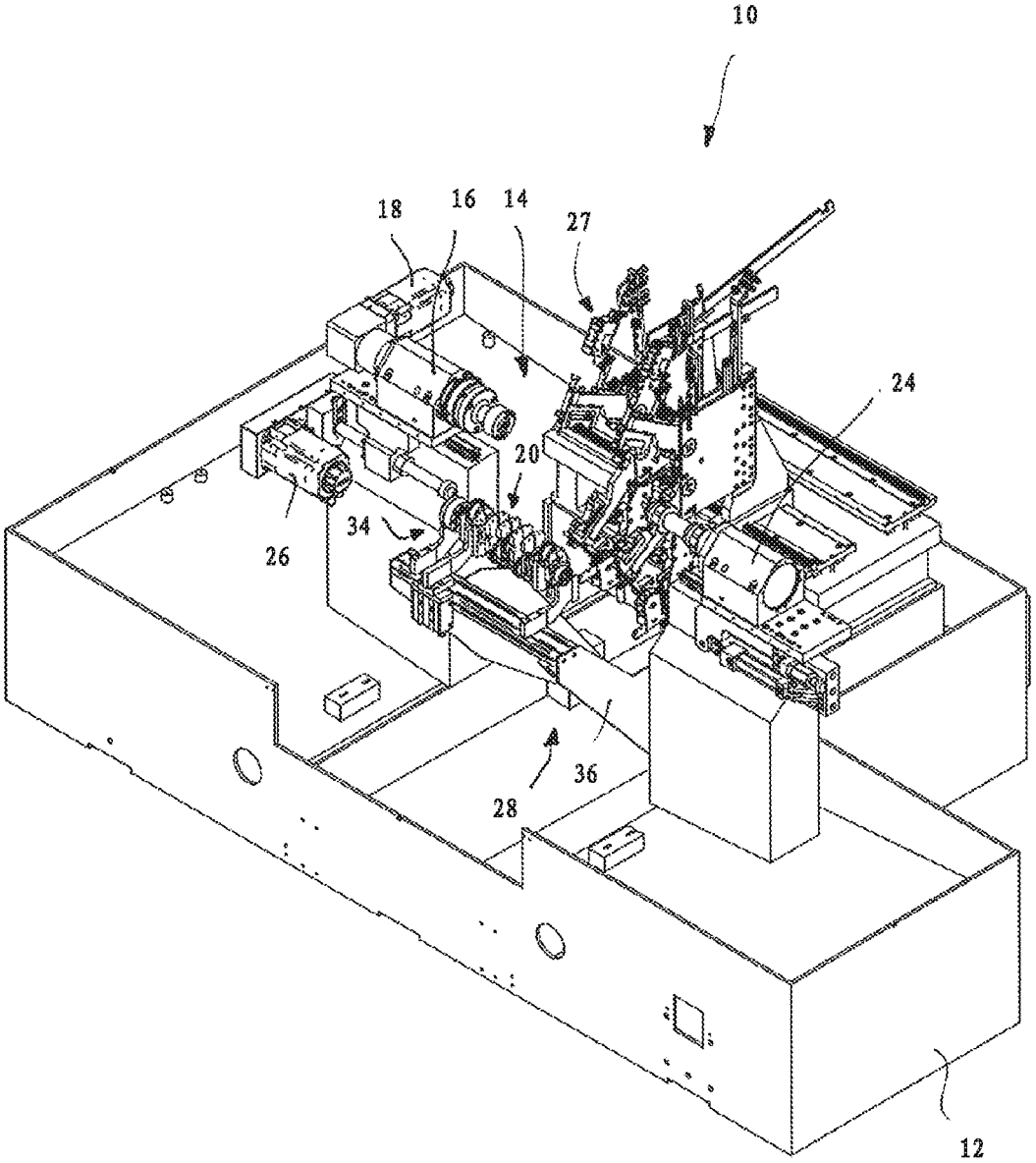
FIG. 1 is a perspective view of an embodiment of a finishing apparatus, in which a workpiece-conveying device is in a loading/unloading position.

In an embodiment, the present invention provides a finishing apparatus which makes it possible to convey a workpiece as quick and simply as possible.

According to an embodiment, a finishing apparatus of the type mentioned at the outset includes a drive device designed as a swivel drive so that the workpiece holder can be swiveled between the working position and the loading/unloading position along an arcuate swivel path.

According to an embodiment of the invention, the workpiece-conveying device of the finishing apparatus comprises a swivel drive, by means of which the workpiece holder is moved along just a single-step conveying path, specifically along an arcuate swivel path. The arcuate swivel path makes it possible to combine a space-consuming first conveying path and a second conveying path, which facilitates the free movement or placing of the support device on the workpiece, in a single-step movement.

The design of the drive device as a swivel drive makes it possible to control the workpiece-conveying device quickly and simply. In this case, only the two end positions, i.e. the working position or the loading/unloading position, need to be approached and correspondingly controlled. Control periods which occur for a multi-step conveying path can be prevented.

Within the scope of the invention, it is possible for the swivel drive to have a structural swivel axle, for the workpiece holder to therefore be held on a swivel arm by means of the support device, which swivel arm is mounted on a structural swivel axle where it is driven for example by means of a drive device acting on the swivel arm.

However, it is also possible within the scope of the invention for the swivel axle not to be structural, but rather for the arcuate swivel path to be provided by a guide, along which the workpiece holder is moved between the working position and the loading/unloading position.

Irrespective of whether the above-described swivel axle is structural or merely corresponds to a virtual swivel axis of an arcuate guide, it is preferable for a swivel axle associated with the swivel path to be laterally offset from the swivel path when viewed in the horizontal direction. In this way, single-step, arcuate swivel paths can be produced at the same time as a relatively well-pronounced shell shape of the support device, as a result of which the workpiece is securely held in a manner assisted by gravity, in the support device is ensured along the entire swivel path.

A geometrically advantageous arrangement is achieved in that the working position is higher than the loading/unloading position relative to the direction of gravity.

The workpiece is held particularly well on the workpiece holder when the support device is formed as a shell that is at least partially open at the top relative to the direction of gravity.

In particular, it is preferable for the shell to have a V-shaped profile. The workpiece is received in said V-shaped profile so as to be held there between two shell portions that are at an angle relative to one another. The angle formed between the shell portions is preferably greater than 90°, in particular greater than 120°. The angle formed between the shell portions is preferably less than 170°, in particular less than 160°.

In particular, it is preferable for the V-shaped profile to comprise a first shell portion which functions as a support surface for the workpiece.

According to a first alternative, the first shell portion extends in a straight plane which is oriented tangentially to the arcuate swivel path. This simplifies the production of the support device and allows for a relative movement between the support device and the workpiece that is as free of undercuts as possible.

According to a second alternative, the first shell portion is curved in the shape of an arc. It is possible for the curvature of the first shell portion to be in the same direction as the circumferential surface of the workpiece, as a result of which particularly gentle contact between the workpiece surface and the first shell portion is possible. However, it is also possible for the first shell portion to have a curvature in the opposite direction to the curvature of the workpiece surface.

In particular, the curvature of the support surface has a radius of curvature which is equal to the radius of the swivel path. In such a configuration, the first shell portion can be moved relative to the workpiece in a manner that is completely free of undercuts.

In another preferred embodiment of the invention, the workpiece-conveying device has a releasable anti-turn device, by means of which a workpiece arranged on the support device can be secured against turning about the workpiece axis. An anti-turn device of this kind preferably interacts with a component of the workpiece that is not rotationally symmetrical relative to the workpiece axis, for example with the connecting rod bearing of a crankshaft. The anti-turn device is fastened in particular to the workpiece holder and/or to a free end of the swivel arm such that the anti-turn device can be swiveled, together with the workpiece holder, between the working position and the loading/unloading position along the arcuate swivel path.

One embodiment of a finishing apparatus 10 shown in the drawings comprises a machine frame 12 for arranging a workpiece-receiving device 14. Said device comprises a headstock 16 having a rotary drive 18 for driving a workpiece 20 in rotation about a workpiece axis 22. The workpiece-receiving device 14 further comprises a tailstock 24.

In order to produce an oscillatory movement superimposed over the rotational movement of the workpiece 20, which oscillatory movement is parallel to the workpiece axis 22, an oscillatory drive 26 is provided. The oscillatory drive is used to move the workpiece-receiving device 14 and the workpiece 20 received therein back and forth in the direction parallel to the workpiece axis. A finishing tool (for example a finishing belt or a finishing stone, not shown in the drawings in order to improve clarity) arranged on a machining unit 27 is pressed against a surface of the workpiece 20 for the finishing process. The superimposition of the rotational movement and the oscillatory movement produces a cross-grinding structure that is characteristic of the finishing process.

Figure 2:
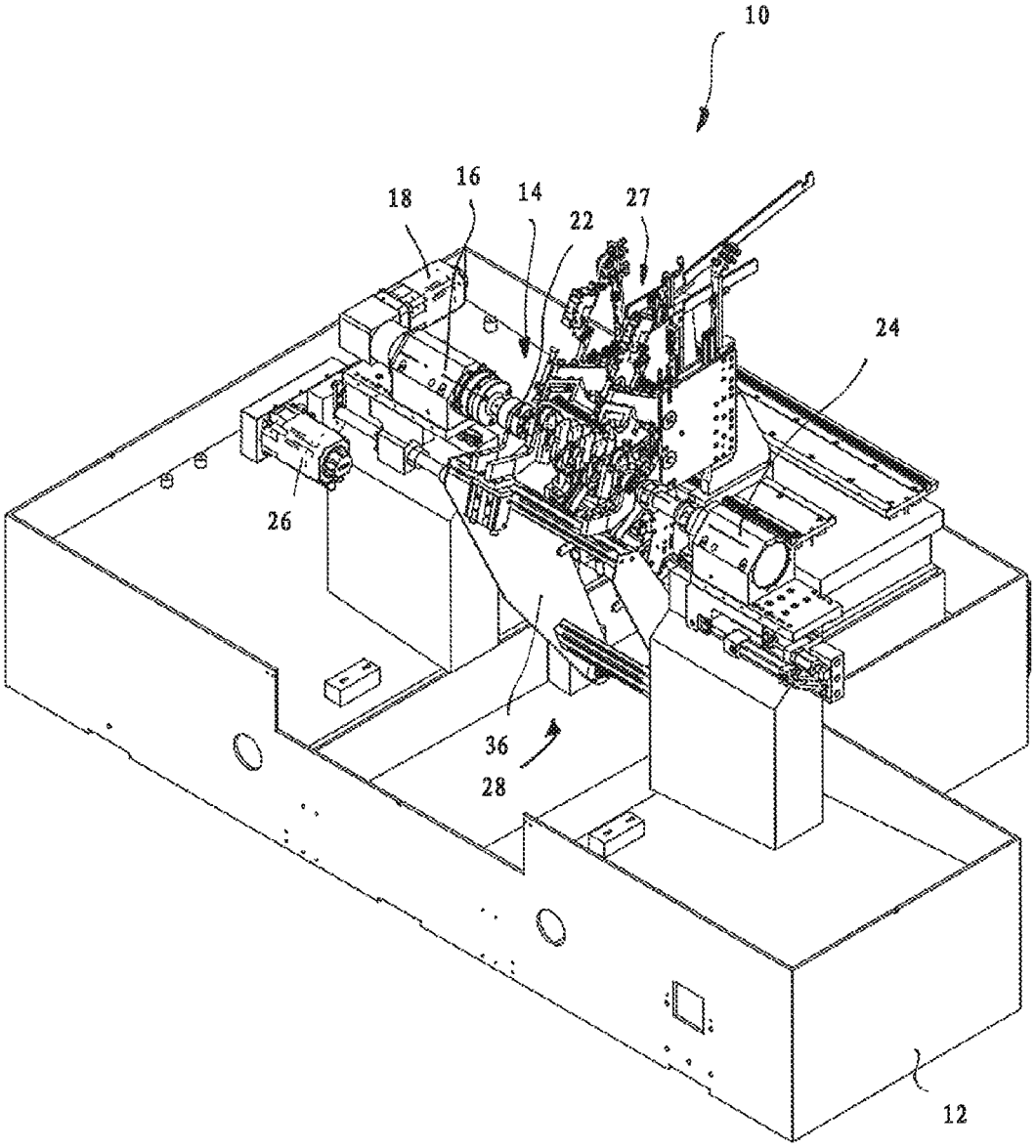
FIG. 2 is a view corresponding to FIG. 1, in which the workpiece-conveying device is in a working position.
Figure 3:
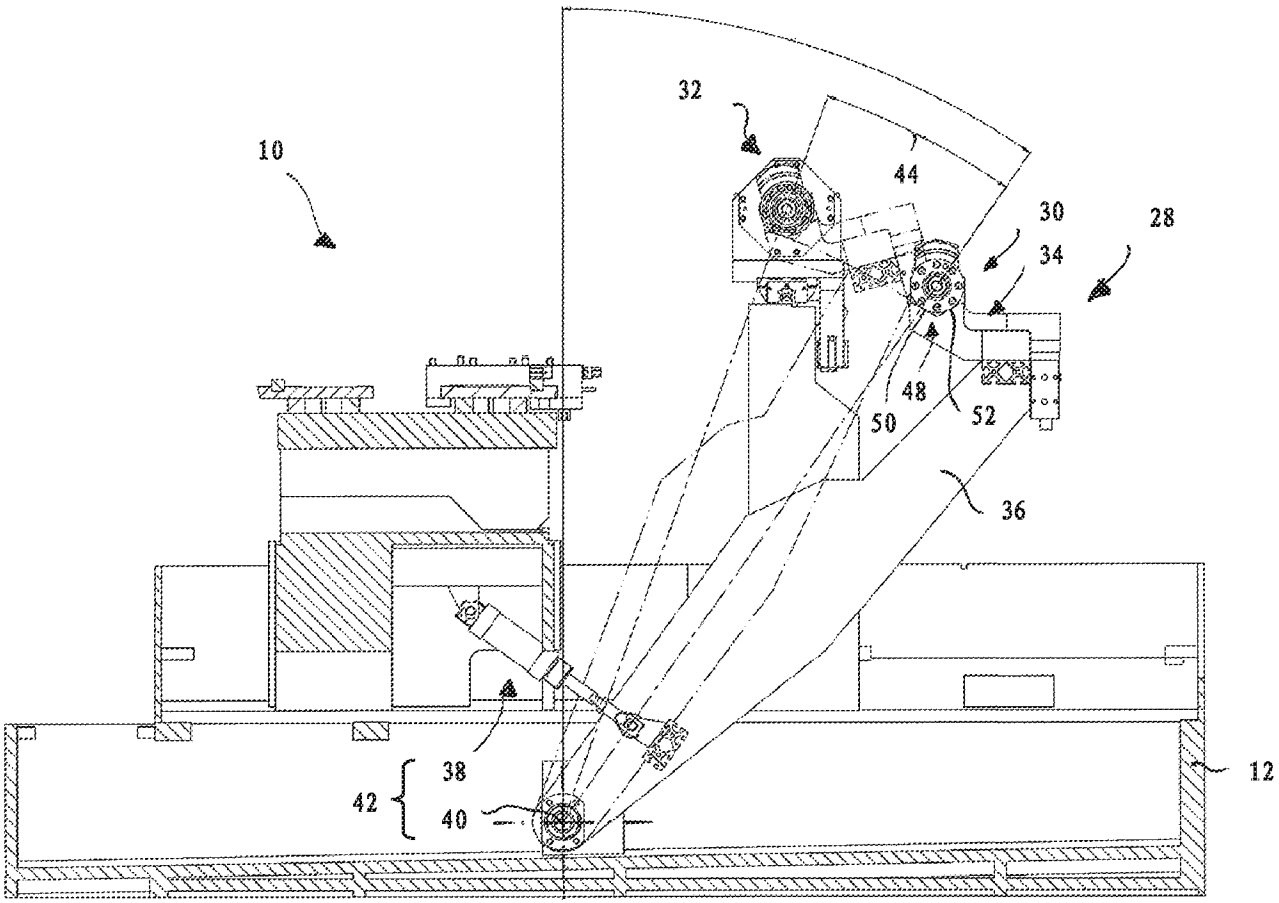
FIG. 3 is a side view of the finishing apparatus according to FIGS. 1 and 2.
Figure 4:
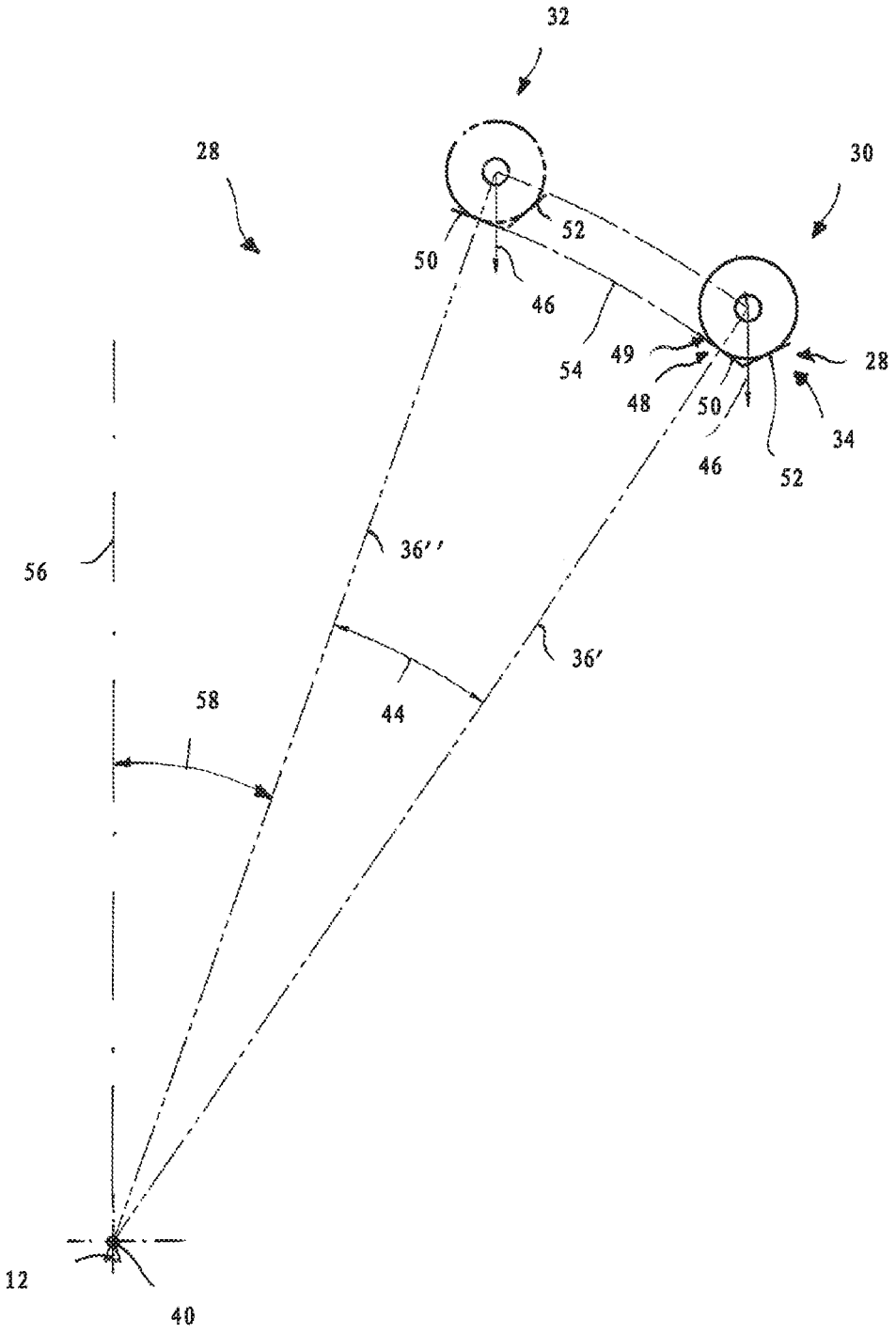
FIG. 4 is a schematic side view of the finishing apparatus according to FIGS. 1 and 2.

The finishing apparatus 10 further comprises a workpiece-conveying device 28 for conveying the workpiece 20 between a loading/unloading position (cf. FIG. 1) and a working position (cf. FIG. 2). In FIGS. 3 and 4, both the loading/unloading position and the working position are shown, the loading/unloading position being denoted by reference sign 30 and the working position being denoted by reference sign 32.

In the loading/unloading position 30, a workpiece 20 to be finished can be supplied from an external magazine or a gantry loader and a finished workpiece 20 can be removed. From the working position 32, a workpiece 20 can be clamped by the workpiece-receiving device 14, in particular between tips of the headstock 16 and the tailstock 24, in a manner known per se.

The workpiece-conveying device 28 comprises a workpiece holder 34, which is fastened to a swivel arm 36. The swivel arm 36 can be driven by means of a drive device 38. In the process, the swivel arm 36 swivels around a swivel axle 40 between a first swivel position 36' and a second swivel position 36". The arrangement of the drive device 38 and swivel axle 40 forms a swivel drive 42.

In the embodiment shown, the drive device 38 is formed as a double-acting hydraulic, pneumatic or electric cylinder, which is supported on the machine frame 12 at one end and on a portion of the swivel arm 36 spaced from the swivel axle 40 at the other end. However, it is also conceivable to use a rotary drive, which drives and swivels the swivel arm 36 in the region of the swivel axle 40.

A swivel angle 44 formed between the swivel positions 36 and 36" is for example between approximately 10° and approximately 70°, preferably between approximately 10° and approximately 20°.

When the swivel arm 36 swivels between the swivel positions 36' and 36", the workpiece holder 34 is swiveled between the loading/unloading position 30 and the working position 32.

The workpiece holder 34 comprises a support device 48 having a shell 49 that is open at the top relative to the direction of gravity 46.

The shell 49 has a V-shaped profile having a first shell portion 50 and having a second shell portion 52 that is at an angle to said first shell portion. The shell portions 50 and 52 each form support surfaces for supporting the workpiece 20.

The first shell portion 50 has a curved shape in the opposite direction to the curvature of the surface of the workpiece 20. The curvature of the first shell portion 50 is such that the radius of curvature of the first shell portion 50 corresponds to the radius of the swivel path of the workpiece holder 34 about the swivel axle 40. In this way, the first shell portion 50 can be moved along an arcuate swivel path 54 relative to the workpiece 20 in a manner that is completely free of undercuts. This applies in particular when a surface, facing upwards relative to the direction of gravity 46, of the first shell portion 50 is arranged at such a depth that, when arranging a workpiece 20 in the workpiece holder 34 and transferring the workpiece holder 34 from the loading/unloading position 30 into the working position 32, the workpiece axis 22 of the workpiece 20 is slightly lower than a clamping axis formed between the tips of the headstock 16 and the tailstock 24. This lower positioning makes it possible to first move the workpiece 20 into a "too low" working position, in order to then bring the tips into engagement with end face recesses in the tool 20. During this engagement, the tips are centered in the recesses and raise the workpiece 20, which is initially still supported on the workpiece holder 34, into a machining position such that the workpiece 20 clamped between the tips is then slightly spaced from the workpiece holder 34. This makes it possible to transfer the workpiece holder 34 from the working position 32 back into the loading/unloading position 30 without the workpiece holder 34 coming into contact with the workpiece 20 during this transfer.

The workpiece 20 is securely held on the workpiece holder 34 or in the shell 49 is also ensured in that the entire swivel path 54 is laterally offset relative to a reference plane 56. The reference plane 56 extends in the vertical direction (in parallel with the direction of gravity 46) and through the swivel axle 40 that extends in the horizontal direction. The swivel path 54 is spaced by an angle 58 relative to the reference plane 56. The angle 58 is preferably at least 10°, in particular at least 20°. The angle 58 is preferably no more than 80°, in particular no more than 70°.

Figure 5:
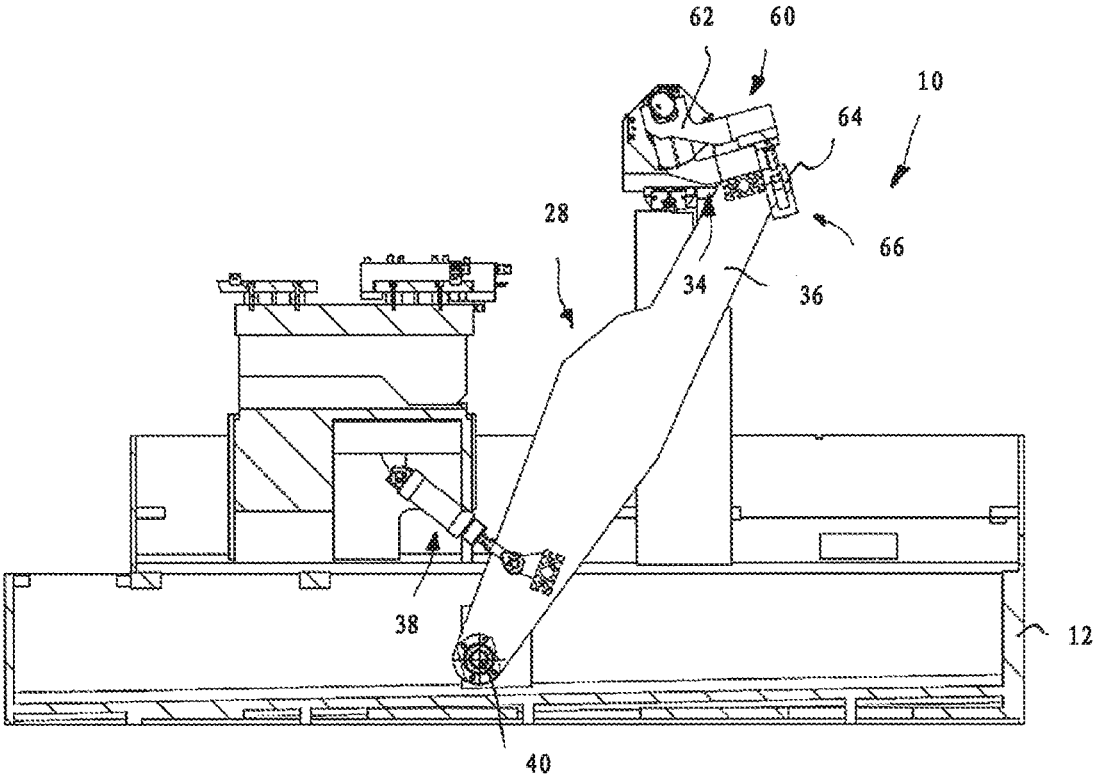
FIG. 5 is another side view of the finishing apparatus according to FIGS. 1 and 2, comprising an activated anti-turn device.
Figure 6:
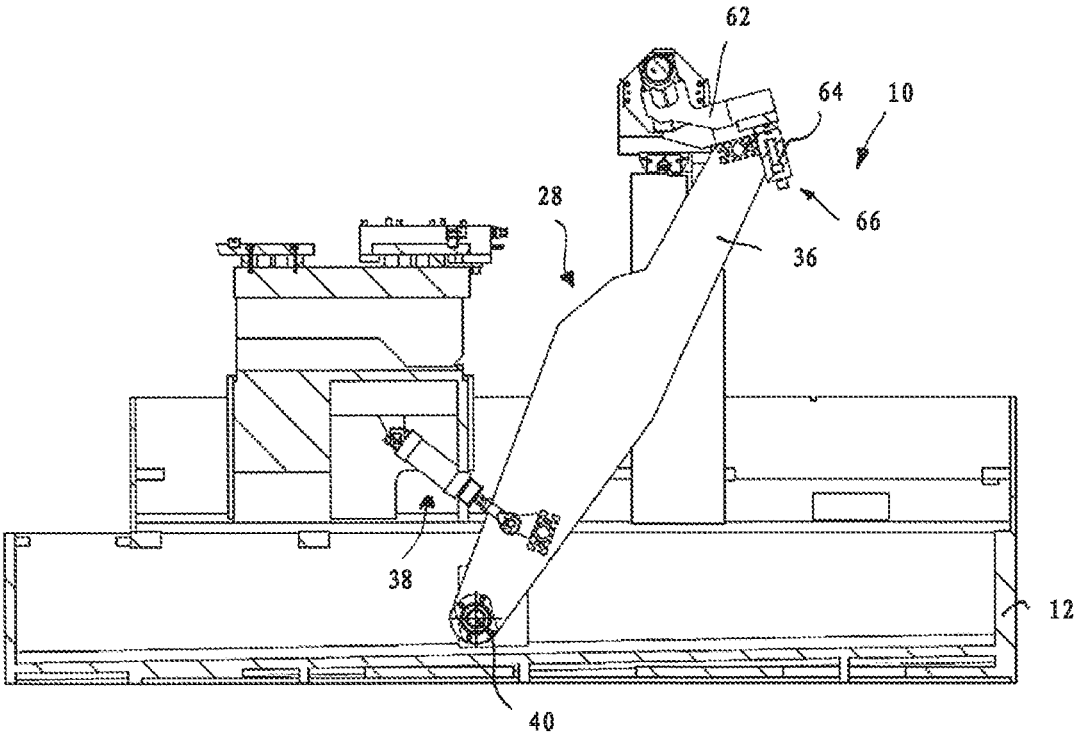
FIG. 6 is a side view corresponding to FIG. 5, comprising a deactivated anti-turn device.

In order to secure the workpiece 20 in a predetermined rotational position, the workpiece-conveying device 28 comprises an anti-turn device 60. Said anti-turn device comprises a forked securing element 62, which can be moved between a securing position (cf. FIG. 5) and a rest position (cf. FIG. 6) by means of an actuator 64. The actuator 64 is fastened to the free end 66 of the swivel arm 36 that is spaced from the swivel axle 40 such that the anti-turn device 60 is swiveled together with the workpiece holder 34.

The workpiece-conveying device 28 makes it possible to convey a workpiece 20 simply and quickly between the loading/unloading position 30 and the working position 32 along the arcuate swivel path 54 that only consists of one step.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A finishing apparatus, comprising:

a workpiece-receiving device;

a rotary drive configured to drive a workpiece in rotation about a workpiece axis an oscillatory drive configured to produce a relative movement between the workpiece and a finishing tool in a direction that is parallel to the workpiece axis;

a workpiece-conveying device having a workpiece holder that is moveable by a drive device between a working position in which the workpiece is in position to be machined and a loading/unloading position in which the workpiece is loadable/unloadable, the workpiece holder comprising a support device configured to support the workpiece, the drive device being formed as a swivel drive such that the workpiece holder is swivelable between the working position and the loading/unloading position along an arcuate swivel path, wherein the workpiece holder is coupled to a fixed swivel axle associated with the swivel path via a single swivel arm, wherein the swivel path is a path traveled by a center point of a first shell portion of the shell from the loading/unloading position to the working position about a swivel axle, the center point being at a support surface of the first shell portion configured to contact the work piece, wherein the support device is formed as a shell that is at least partially open at the top relative to the direction of gravity, wherein the shell has a V-shaped profile that comprises the first shell portion, which includes the support surface for the workpiece, and wherein the top surface of the first shell portion:

extends in a straight plane that is tangential to the swivel path, or is curved in the shape of an arc, the curvature of the support surface having a radius of curvature which is equal to the radius of the swivel path.

2. The finishing apparatus according to claim 1, wherein a swivel axle associated with the swivel path is laterally offset from the swivel path when viewed in the horizontal direction.

3. The finishing apparatus according to claim 1, wherein the working position is higher than the loading/unloading position relative to the direction of gravity.

4. The finishing apparatus according to claim 1, wherein the workpiece-conveying device comprises a releasable anti-turn device by which a workpiece arranged on the support device is securable against turning about the workpiece axis.

5. The finishing apparatus according to claim 1, wherein the first shell portion is free or substantially free of undercuts with respect to the workpiece.

6. The finishing apparatus according to claim 1, wherein the first shell portion is curved in the shape of an arc, the curvature of the support surface having the radius of curvature which is equal to the radius of the swivel path.

7. The finishing apparatus according to claim 1, wherein the workpiece holder is moveable by the drive device between the working position and the loading/unloading position along only a single-step conveying path.

8. The finishing apparatus according to claim 4, wherein the releasable anti-turn device comprises an actuator and a fork securing element, the actuator configured to move the forked securing element between a securing position and a rest position, the forked securing element being configured to secure the workpiece in a predetermined rotational position when in the securing position.

* * * * *